US008127753B1

(12) United States Patent
Brooks et al.

(10) Patent No.: US 8,127,753 B1
(45) Date of Patent: Mar. 6, 2012

(54) TOY PROJECTILE LAUNCHER

(75) Inventors: Meredith Reid Brooks, Attleboro, MA (US); Raymond Aaron Mead, Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 681 days.

(21) Appl. No.: 12/203,704

(22) Filed: Sep. 3, 2008

(51) Int. Cl.
*F41B 11/02* (2006.01)

(52) U.S. Cl. ..... 124/66; 42/54

(58) Field of Classification Search ..... 124/32, 124/66; 42/54, 55
See application file for complete search history.

(56) References Cited

U.S. PATENT DOCUMENTS

| | | | |
|---|---|---|---|
| 688,217 | A | 12/1901 | Whiting |
| 2,835,171 | A | 5/1958 | Lyon |
| 2,930,041 | A | 3/1960 | Massacrier |
| 3,009,453 | A | 11/1961 | Ayala |
| 3,159,060 | A | 12/1964 | Miles |
| 4,091,981 | A | 5/1978 | Moriguchi et al. |
| 4,159,705 | A | 7/1979 | Jacoby |
| 4,834,058 | A | 5/1989 | Gegere |
| 4,843,751 | A | 7/1989 | Ferri |
| 4,856,410 | A | 8/1989 | Anderson |
| 5,186,156 | A | 2/1993 | Clayton |
| 5,522,374 | A | 6/1996 | Clayton |
| 5,529,050 | A | 6/1996 | D'Andrade |
| 5,535,729 | A | 7/1996 | Griffin et al. |
| 5,660,159 | A | 8/1997 | Clayton |
| 5,680,853 | A | 10/1997 | Clayton |
| 5,787,869 | A | 8/1998 | Johnson et al. |
| 5,791,326 | A | 8/1998 | Brown et al. |
| 6,439,216 | B1 | 8/2002 | Johnson et al. |
| 6,481,137 | B2 | 11/2002 | Kornberger |
| 7,287,526 | B1 | 10/2007 | Bligh et al. |
| 2008/0229642 | A1 * | 9/2008 | Hu ..... 42/54 |

FOREIGN PATENT DOCUMENTS

WO WO 2007137587 * 12/2007

* cited by examiner

*Primary Examiner* — Stephen M Johnson
(74) *Attorney, Agent, or Firm* — Perry Hoffman

(57) ABSTRACT

A toy projectile launcher for launching a projectile from a housing having a trigger mounted to the housing which can be depressed to actuate a motor. A mechanical linkage operatively interconnects the motor with an actuator which generates a source of pressurized air upon movement of the actuator from its cocked to its un-cocked position to effect automatic repeated movement of the actuator to its cocked position and release from its cocked position. Repeated intermittent sources of pressurized air are generated for sequential launching of projectiles. Disclosed embodiments also include a toy projectile launcher having an air passageway through which compressed air is passable to a plurality of sequential projectile holders holding respective projectiles to be launched. The projectile holders are advanced into operative launching engagement with the air passageway sequentially by an advancing mechanism.

15 Claims, 7 Drawing Sheets

TOY PROJECTILE LAUNCHER

FIELD OF THE INVENTION

The present invention relates generally to toys and more particularly to activity toys including toy projectile launchers.

BACKGROUND OF THE INVENTION

Toy projectile launchers, such as toy guns for shooting toy darts and the like, have been around for several years. Such toy projectile launchers have been designed to launch projectiles in a wide variety of ways. However, current and prior toy projectile launchers have shortcomings which are desired to be overcome.

For instance, current and prior toy projectile launchers which allow for automatic sequential firing of projectiles rely on a pressurized canister to provide the launching force for the projectiles. Such pressurized canisters are undesirably bulky, and also in the event of a leak in the pressurized canister the projectile launcher may not operate properly. Also, it is desirable to assure that only the toy projectiles provided with the toy projectile launcher are used, and improvised projectiles prevented from being launched, and there is a desire for improved mechanisms for preventing the launching of undesirable improvised projectiles.

SUMMARY OF THE INVENTION

In accordance with the present invention, various advantageous toy projectile launchers are provided which overcome shortcomings associated with current and prior toy projectile launchers.

Described embodiments include a toy projectile launcher for launching a projectile having a housing with a trigger mounted to the housing which can be depressed to actuate a motor. A mechanical linkage is operatively interconnecting the motor with an actuator which generates a source of pressurized air upon movement of the actuator from its cocked to its un-cocked position to effect automatic repeated movement of the actuator to its cocked position and release from its cocked position, whereby repeated intermittent sources of pressurized air are generated for sequential launching of projectiles. Projectile holders are advanced into operative launching engagement with the air passageway sequentially by an advancing mechanism.

Described embodiments also include a toy projectile launcher having the air passageway through which compressed air is passable to a plurality of sequential projectile holders holding respective projectiles to be launched. The projectile holders are advanced into operative launching engagement with the air passageway sequentially by an advancing mechanism. A retractable safety valve mechanism is achieved and movable between a retracted position so as not to interfere with the projectile holders during their sequential advancement. An extended position extending into the projectile holder is provided while the projectile holder is in its operative launching engagement with the air passageway, with the retractable safety valve mechanism having a dart sensing portion which is movable between an air passageway occluding position in which air is prevented from passing through the air passageway in the absence of the dart sensing portion detecting the presence of a suitable projectile in the projectile holder when the safety valve mechanism is extended into the projectile holder to prevent non-suitable darts from being launched, and an air passageway open position in which air is allowed to pass through the air passageway upon the dart sensing portion detecting the presence of a suitable projectile in the projectile holder when the safety valve mechanism is extended into the projectile holder to allow suitable darts to be launched.

BRIEF DESCRIPTION OF THE DRAWINGS

For the purpose of facilitating an understanding of the inventions, the accompanying drawings and description illustrate a preferred embodiment thereof, from which the inventions, structure, construction and operation, and many related advantages may be readily understood and appreciated.

DETAILED DESCRIPTION OF THE PREFERRED EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
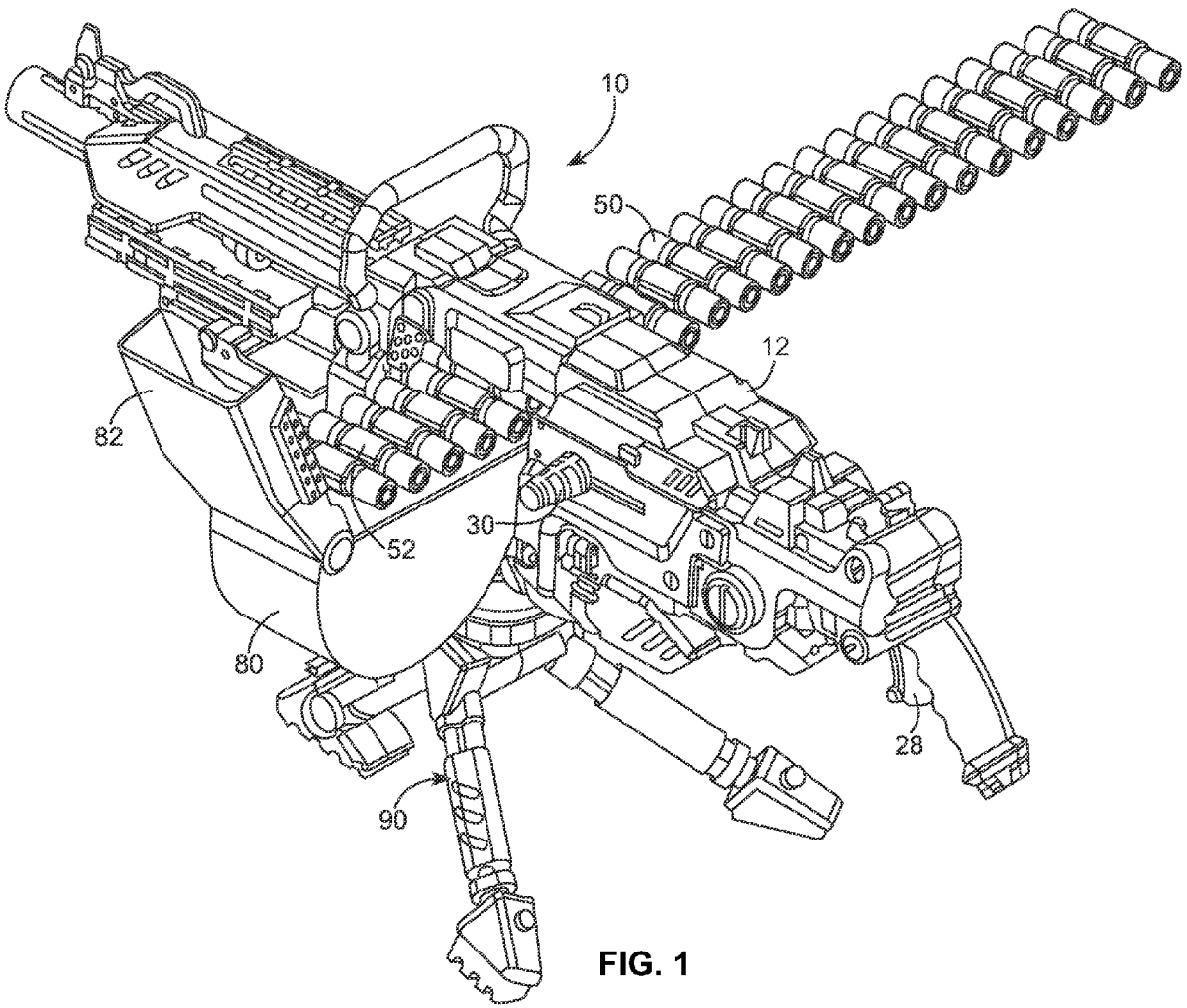
FIG. 1 is a perspective view of a toy projectile launcher embodying various features of the present invention.
Figure 2:
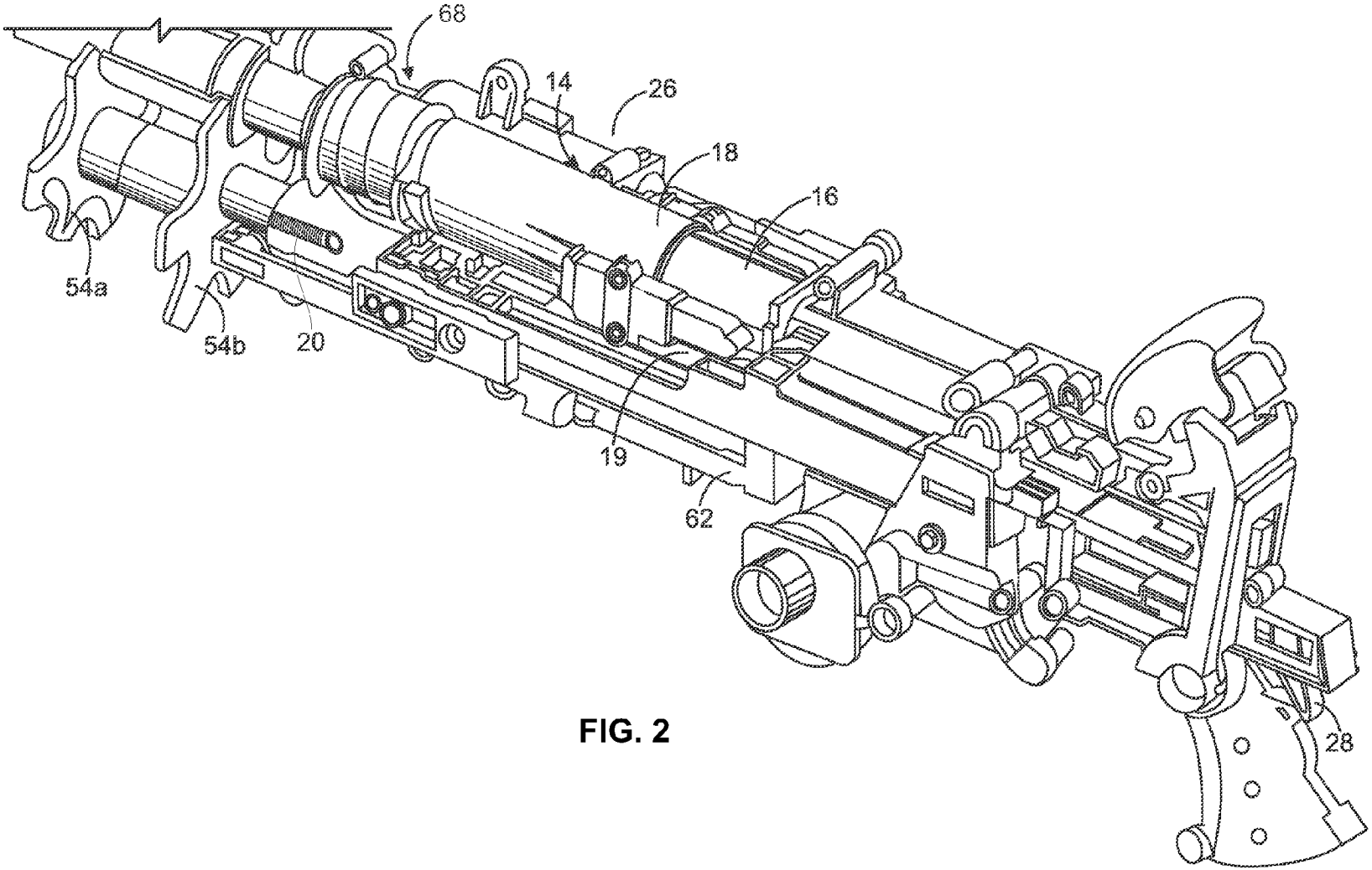
FIG. 2 is a perspective view of the toy projectile holder of FIG. 1 shown with various components removed to show its interior.
Figure 3:
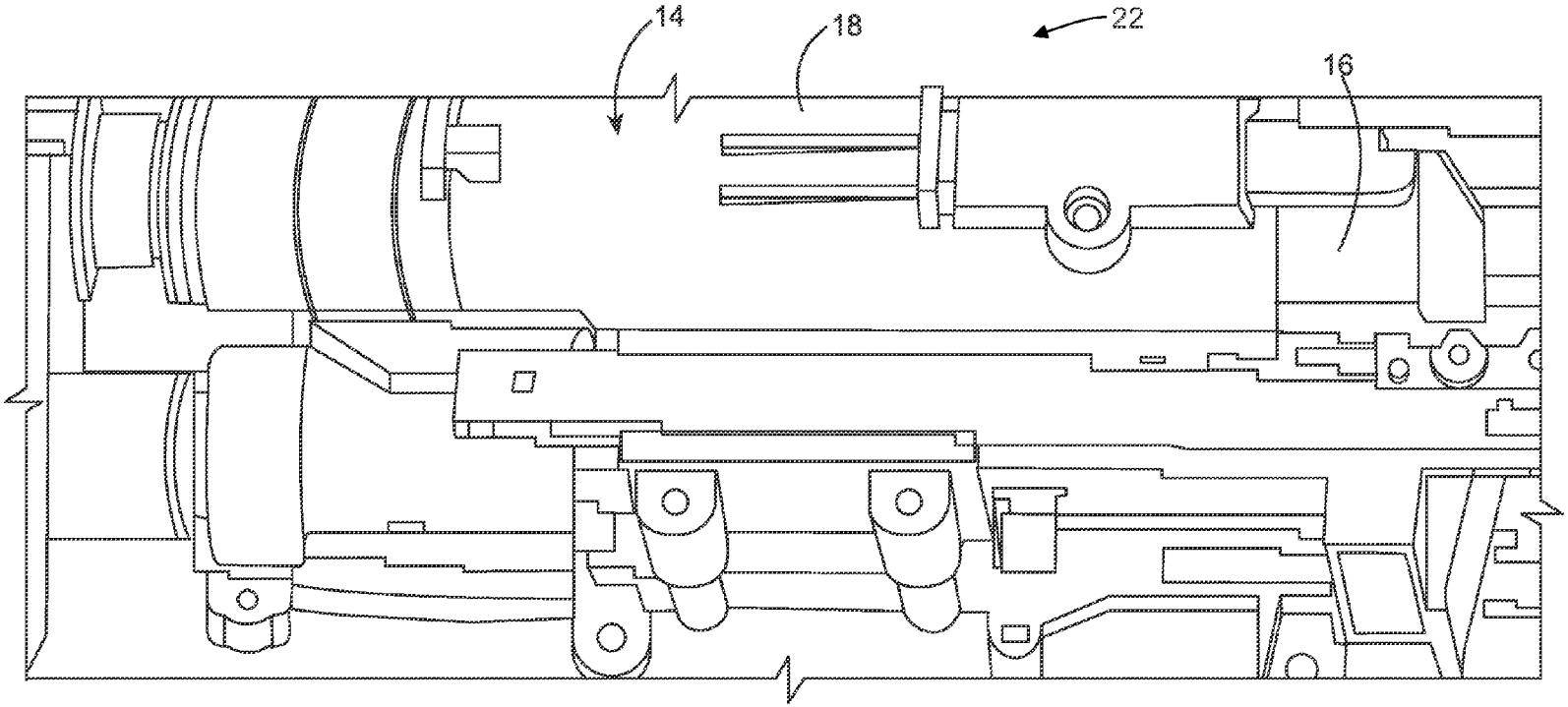
FIG. 3 is a side, elevational view of the piston and cylinder portion of the toy projectile launcher of FIG. 1.
Figure 4:
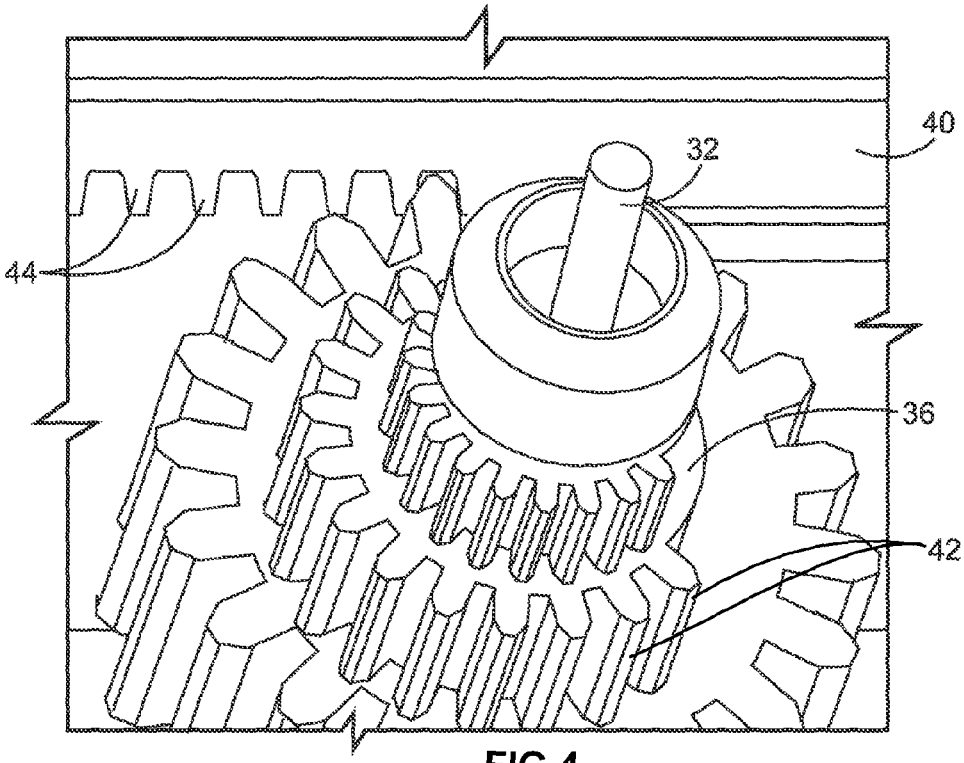
FIG. 4 is an enlarged partial perspective view of the sector gear and rack gear of the toy projectile launcher of FIG. 1.
Figure 5:
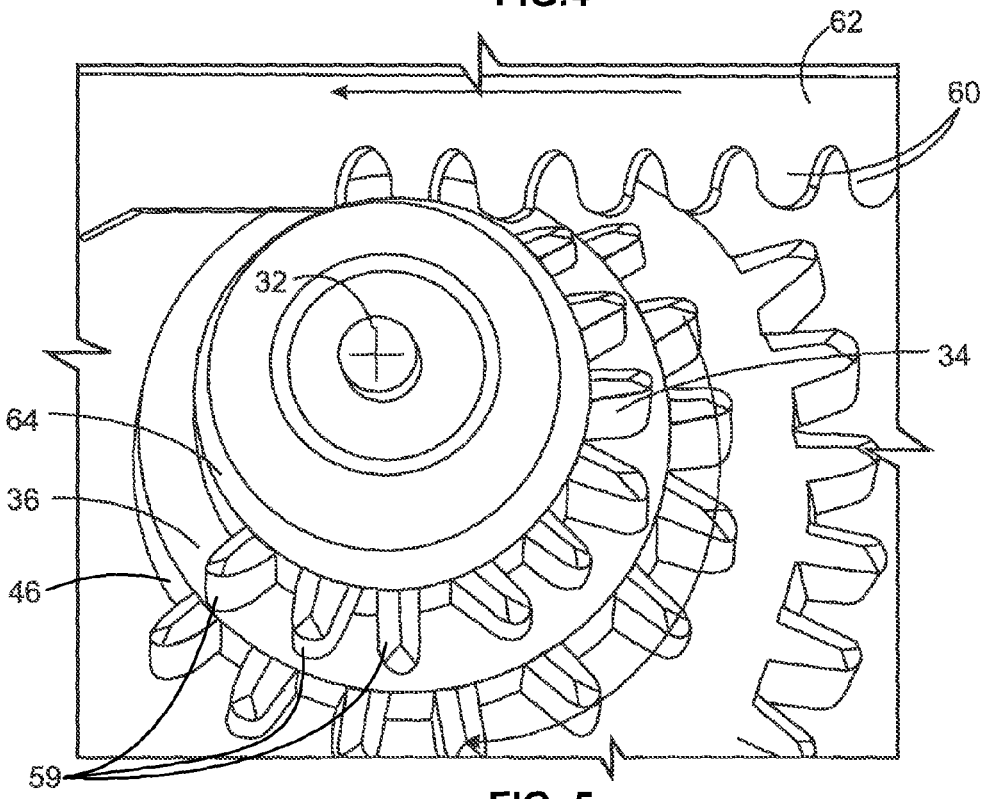
FIG. 5 is an enlarged partial perspective view of the sector gear and rack gear of the toy projectile launcher of FIG. 1 disengaged.

Referring now to the Figures, toy projectile launchers embodying various aspects of the present invention is shown in FIGS. 1 through 10. It will be readily apparent to those skilled in the art, however, that the toy projectile launchers of FIGS. 1 through 10 represents but a few of the wide variety of structures, configurations and modes of operation of toy projectile launchers which fall within the scope of the present invention. With reference to FIG. 1, the toy projectile launcher 10 has a housing 12 which may be of any desired configuration to provide functional and/or aesthetic play value. An actuator mechanism, referenced generally by numeral 14, for generating a burst of pressurized air for effecting launching of projectiles by the force of the pressurized air, is mounted to the housing 12 in a suitable manner. The illustrated actuator mechanism 14 has a cylinder and piston assembly comprising a piston member 16 and a cylinder member 18 which receives the piston member 16 therein, with the piston member 16 being slidable within the cylinder member 18. The piston and cylinder assembly generates a source of pressurized air when the piston member 16 and cylinder member 18 move rapidly relative to one another to displace the air in the cylinder member, which source of pressurized air is used to launch projectiles.

The illustrated toy projectile launcher 10 is constructed such that the cylinder member 18 is slidably mounted to the housing, and such that during operation the cylinder member 18 is first slid forward into abutment with safety valve mechanism 68 (which is optional, and described in greater detail below), such that a continuous air passageway is formed which extends from the interior of the cylinder member 18 at which the pressurized air is generated to the projectile to be launched. This forward sliding of the cylinder member 18 is carried out by a lever 19 which pivots to push the cylinder member 18 forward by level action as the sprocket advancing rack gear 62 (described in greater detail below) is advanced rearwardly. The sprocket advancing rack gear 62 may be manually advanced rearwardly (and hence the cylinder member 18 advanced forwardly) by pulling the cocking handle rearwardly for single-shot manual projectile firing mode, or alternatively the sprocket advancing rack gear 62 may be automatically advanced rearwardly (and hence the cylinder member advanced forwardly) by engagement of the sprocket advancing rack gear 62 with the rotational sprocket advancing sector gear 34 when the toy projectile launcher 10 is operated in automatic mode for rapid sequential firing of projectiles. The cocking handle may extend outwardly of the housing on either one side or both sides.

Although the actuator in the illustrated embodiments comprises a piston and cylinder assembly with a reciprocating piston which is moved relative to the stationary cylinder, it is recognized that a variety of other actuators may be utilized such as other piston and cylinder assemblies which have a stationary piston with a reciprocating cylinder which is moved relative to the stationary piston, or a piston and cylinder which both move relative to one another, or other mechanisms utilizing members other than pistons and cylinders. With the cylinder member 18 advanced and temporarily held in its forward position by the lever 19, the cylinder and piston assembly 14 is moved to its cocked position against the force of biasing spring 20 which biases the piston and cylinder assembly 14 toward its un-cocked position. The piston and cylinder assembly 14 is retained in its cocked position until it is released from its cocked position by depression of the trigger 28. When the piston and cylinder assembly is in its cocked position, the biasing spring is compressed and thus represents a source of stored energy, whereby the piston and cylinder assembly actuator mechanism is in a stored energy position. When the piston and cylinder assembly 22 released from its cocked position, the force of the biasing spring moves the piston and cylinder relative to one another, and a force of pressurized air is thereby created which is used to launch the projectiles.

A piston engaging member 26 is provided which is movable to a piston retaining position to retain the piston member 16 in its cocked, energy storing position until the trigger 28 is actuated, with movement of the trigger to its actuated (typically, depressed) position moving the piston engaging member 26 to its piston releasing position for releasing the piston member 16 to effect launching of one or more projectile in either manual or automatic mode of operation. The piston engaging member 26 may be biased toward its piston retaining position to automatically engage the piston when it is moved to its cocked position in manual mode such as by a camming ramp which overcomes the biasing force of the piston engaging member as the piston is moved to its cocked position and then releases the piston engaging member 26 whereupon it is moved by the biasing force into the piston engaging position to retain the piston in its cocked, energy stored position until the trigger 28 is depressed to release the piston and launch a projectile.

Whether the toy projectile launcher 10 is operated in manual or automatic mode, the piston engaging member 26 is moved and retained in its piston releasing position for so long as the trigger 28 is depressed. Accordingly, when the toy projectile launcher 10 is operated in automatic mode as discussed above and further below, the piston retaining member 26 is kept out of engagement with the piston while the trigger is depressed or otherwise actuated, whereby the piston member 16 is allowed to move repeatedly between its cocked and un-cocked positions without interference by the piston retaining member 26.

For operating the toy projectile launcher 10 in manual mode, the cocking handle 30 is operatively connected to the piston member 16 and extends outwardly of the housing 12 to allow the user to manually grasp the cocking handle 30 and pull it from a forward un-cocked position to a rearward cocked position, to manually move the piston member 16 from its un-cocked position to its cocked position (as well as move the cylinder to its forward position discussed above). Upon reaching its cocked position, the piston 16 will be retained in the cocked position by the engagement of the piston engaging member 26 with the piston 16. Upon subsequent depression of the trigger 28, the piston engaging member 26 is disengaged from the piston 16 whereupon the piston moves rapidly to its un-cocked position which creates the burst of pressurized air for launching a projectile (or a plurality of projectiles simultaneously). In this manner, the toy projectile launcher 10 may be operated in a manual mode, with a single launch (which may be of one or more than one projectile) being carried out upon each pulling back of the cocking handle 30 to its cocked position and subsequently depressing the trigger 28. Thus, the toy projectile launcher may be operated in manual mode without batteries.

The toy projectile launcher 10 is also capable of operating in an automatic mode to allow one or more projectiles to be sequentially launched in rapid succession. A piston cocking rack gear 40 is slidably mounted to the housing for forward and rearward sliding movement along the housing. The piston cocking rack gear 40 is engaged with the piston member 16 such that rearward movement of the piston cocking rack gear 40 effects rearward movement of the piston member 16 to its cocked position. The piston cocking rack gear 40 is also intermittently engaged with piston cocking sector gear 36 which moves the piston cocking rack gear 40, and hence also the piston member 16, to its cocked position and releases the piston member 16 from its cocked position, as discussed below.

A motor 32 is mounted to the housing 12 and operatively engaged to a pair of co-axial sector gears (sprocket advancing sector gear 34 and piston cocking sector gear 36), whereby the sector gears 34 and 36 rotate when the motor is actuated. The sector gears 34 and 36 have a plurality of gear teeth extending over only a portion of their circumferences, with no gear teeth, and hence a reduced diameter, over the remaining portion of their circumferences. During the portion of the rotation of the piston cocking sector gear 36 in which the teeth 42 of the piston cocking sector gear 36 are engaged with the teeth 44 of the piston cocking rack gear 40, rotation of the piston cocking sector gear 36 causes rearward movement of the piston cocking rack gear 40, which causes rearward sliding movement of the piston member 16 in the cylinder member 18 to its cocked position. The piston member 16 is biased, such as by a compression spring, toward its un-cocked position. The motor 32 is rotated in a direction and with sufficient force to overcome the force of the piston biasing spring such that during the portion of its rotation in which the teeth 42 of the cylinder cocking sector gear 36 are engaged with the teeth 44 of the cylinder cocking rack gear 40, the rotation of the cylinder cocking sector gear 36 moves the piston cocking rack gear 40 and associated piston 16 to its cocked, energy stored position.

At the end of the series of teeth 42 engaging with the piston cocking rack gear 36, when the toothless portion 46 of the piston cocking sector gear 36 becomes adjacent to the piston cocking rack gear 40, the piston cocking rack gear 40 becomes disengaged from the piston cocking rack gear 40 whereupon the piston cocking rack gear 40 is released allowing the piston member 16 both move rapidly under the force of the biasing spring to its un-cocked, energy released position which creates a source of pressurized air for launching one or more projectiles. The piston cocking rack gear 40 which is engaged with the piston member 16 is moved back to its original forward position upon the movement of the piston member to its forward, un-cocked position.

Upon further rotation of the piston cocking sector gear 36 by the motor 32, the piston cocking rack gear 40 and the piston 16 remain in this un-cocked position during the remainder of the portion of the piston cocking sector gear rotation over which the toothless portion 46 rotates adjacent the piston cocking rack gear 40, and the teeth 42 of the piston cocking sector 36 remain out of engagement with the teeth 44 of the piston cocking rack gear 40. Upon further, or continued, actuation of the motor, and hence further rotation of the piston cocking sector gear 36 by the motor, when the teeth 42 of the piston cocking sector gear 36 are once again brought into engagement with the teeth 44 of the piston cocking rack gear 40, further rotation of the piston cocking sector gear 36 causes the piston cocking rack gear 40 and associated piston 16 to again move back to its cocked, energy stored position. And again, upon still further, or continued, actuation of the motor and hence further rotation of the piston cocking sector gear 36 by the motor when the toothless portion 46 of the piston cocking sector gear 36 becomes adjacent to the piston cocking rack gear 40, the piston cocking rack gear 40 once again becomes disengaged from the piston cocking rack gear 40 whereupon the piston cocking rack gear 40 is released allowing the piston member 16 to move rapidly under the force of the biasing spring to its un-cocked, energy released position which creates a subsequent source of pressurized air for again launching one or more projectiles. And again, the piston cocking rack gear 40 which remains engaged with the piston member 16 is moved back to its original forward position upon the movement of the piston member to its forward, un-cocked position.

Accordingly, upon prolonged depression or other actuation of the trigger, and hence prolonged actuation of the drive motor 32, the piston 16 is repeatedly moved to its cocked position and released to move rapidly back to its un-cocked position, over and over again to effect a rapid sequence of blasts of pressurized air for launching projectiles in rapid sequence. The number of projectile launches corresponds to the amount of time the trigger is depressed, and hence the amount of time the motor drive is actuated. In the illustrated embodiments, the trigger 24 serves as both a mechanical switch for moving the piston retaining member to its actuator releasing position, and also an electrical switch for actuating the drive motor to effect repeated sequential movement of the actuator to its cocked position and release from its cocked position. In this regard, the continued depression of the trigger maintains the piston engaging member 26 out of engagement with the piston 16 throughout the automatic repeated sliding movements of the piston to its cocked position and associated releases to its un-cocked position.

An on/off switch 48 (or "manual/automatic" switch) may be provided which is operatively engaged with the trigger 28, and/or the power source (which preferably is in the form of batteries mounted in the housing, not shown) and/or the motor 32. When the on/off switch 48 is in its off position, or manual mode, closing of the electrical switch by depression of the trigger does not actuate the drive motor 32, regardless of how long the trigger is depressed. When the switch 48 is in its on position, or automatic mode, closing of the electrical switch by depression of the trigger actuates the drive motor 32 for so long as the trigger continues to be depressed, and/or each time the trigger is depressed for so long as it is depressed each time, effecting automatic repeated cocking and releasing of the piston 16 for automatic sequential launching of a plurality of projectiles.

Figure 6:
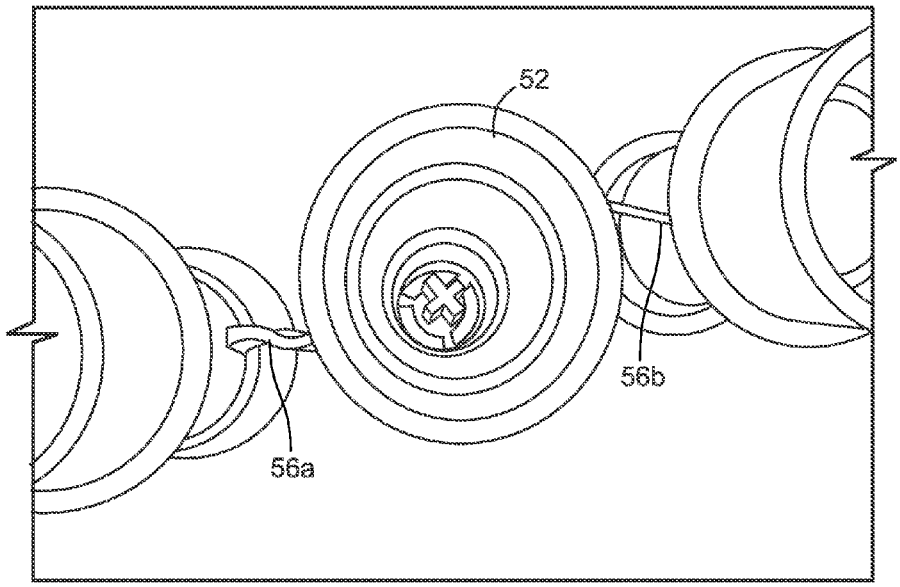
FIG. 6 is an enlarged end view of a projectile holder embodying various aspects of the present invention.

In accordance with another aspect of the invention, projectiles 50 may be sequentially and automatically brought into fluid communication with the interior of the cylinder, and hence the blasts of pressurized air, for being launched sequentially and automatically by the pressurized air which is generated in the cylinder (or other pressurized air actuator). In the illustrated embodiment, a plurality of interconnected projectile holders 52 (as seen in FIGS. 1 and 6) are provided, each having a projectile receiving interior for receiving a respective projectile 50 therein. The series of interconnected projectile holders may be constructed of a plurality of plastic projectile holders fastened to a fabric belt to allow flexibility between adjacent projectile holders, and this is sometimes referred to as an ammunition belt. Each projectile holder 52 is supportable on a pair of rotating sprockets, front sprocket **54*a* and rear sprocket 54*b*, which are respectively received between a pair of front laterally spaced sprocket receiving ribs 56*a* at a front portion of the projectile holder 52, and a pair of rear laterally spaced sprocket receiving ribs 56*b* at a rear portion of the projectile holder 52. The front and rear sprockets 54*a* and 54*b* are rotatable together (as described further below), and the spacing between the sprockets and projectile holders 52 along the belt is such that rotation of the sprockets 54*a* and 54*b* sequentially advances successive projectile holders 52 into operative launching position and fluid communication with the pressurized air generated in the cylinder member 18 by movement of the piston 16. The engagement of the front and rear sprockets 54*a* and 54*b* within the pairs of front and rear ribs 56*a* and 56*b* of each projectile holder 52 maintains the projectile holder 52 in its operative launching position during each launching of a projectile 50** from its projectile holder.

As mentioned above, the toy projectile launcher 10 has a sprocket advancing sector gear 34 which is coaxial with and rotates together with the piston cocking sector gear 36 upon actuation of the drive motor 32. As with the piston cocking sector gear 36, the sprocket advancing sector gear 34 has a plurality of gear teeth extending over only a portion of its circumference, with no gear teeth, and hence a reduced diameter, over the remaining portion of its circumference. When the teeth 59 of the sprocket advancing sector gear 34 are engaged with the teeth 60 of the sprocket advancing rack gear 62, rotation of the sprocket advancing sector gear 34 causes rearward sliding movement of the sprocket advancing rack gear 62. The sprocket advancing rack gear 62 is biased toward its forward position. The motor 32 is rotated in a direction and with sufficient force to overcome the biasing force acting on the sprocket engaging rack gear 62 such that during the portion of its rotation in which the teeth 59 of the sprocket advancing sector gear 34 are engaged with the teeth 60 of the sprocket advancing rack gear 62, the rotation of the sprocket advancing sector gear 34 moves the sprocket advancing rack gear 62 in its sprocket advancing direction, which effects rotary advancement of the front and rear sprockets 54*a* and 54*b* to move a next projectile holder 52 into operative launching position (through any of several mechanisms known in the art). At the end of the series of sprocket advancing sector gear teeth 59 engaging with the teeth 60 of the sprocket advancing rack gear 62, when the toothless portion 64 of the sprocket advancing sector gear 34 becomes adjacent to the sprocket advancing rack gear 62, the sprocket advancing rack gear 62 becomes disengaged from the sprocket advancing sector gear 34 whereupon the sprocket advancing rack gear 62 moves back to its initial position under the force of the biasing spring. This moves the cylinder member 18 back to its initial rearward position as well.

Hence, when the toy projectile launcher 10 is operated in automatic mode, the sprocket advancing rack gear 62 is repeatedly moved to a rearward position and released to move under the biasing force to its forward position. The rearward movement of the sprocket advancing rack gear 34 effects both forward advancement of the cylinder member 18 (through the lever 19 extending between the sprocket advancing rack gear 34 and the cylinder member 18 as discussed above), and also rotational advancement of the sprockets 54*a* and 54*b*. Concurrently, the piston cocking rack gear 40 is repeatedly moved to its rearward position and released to move under the forward biasing force acting on the piston. Accordingly, a single motor may be used to control the advancing motion of the ammunition belt and the automatic firing of projectiles. The rack and sector gears, and the sprocket advancing mechanism and actuating mechanism are constructed such that the projectile holder is moved into its operative launching position, and the cylinder moved to its forward position, prior to the piston being released to generate the pressurized air and launching the projectile from the projectile holder.

Accordingly, upon prolonged actuation of the drive motor 32 when the trigger 28 is depressed for an extended period in automatic mode, the sprockets 54*a* and 54*b* are repeatedly sequentially rotated in synchronization with repeated sequential forward movement of the cylinder member and cocking and uncocking movement of the piston, such that projectile holders are repeatedly and sequentially brought into operative launching position and the projectiles therein subsequently launched by the synchronized generation of pressurized air produced by the repeated and sequential release of the piston member. After each projectile holder has been moved into its operative launching position and its projectile launched, it is then moved out the other side of the launcher upon the next advancement of the sprockets.

In accordance with another aspect of the invention, to help prevent launching of darts or other things not provided with the toy projectile launcher, which are sometimes referred to as improvised projectiles, each of the projectile holders may have an internal pin extending longitudinally along the central longitudinal axis of the projectile holders (see FIG. 6), such that only darts having an annular cross section can be received in the projectile holders. Other projecting members and/or profiles may be used to extend into the interiors of the projectile holders, with the associated projectiles having corresponding complementary configurations to allow them to be received within the projectile holders and launched from the projectile holders, while preventing non-conforming projectiles from being received within the projectile holders and launched from the projectile holders.

In accordance with another aspect of the invention, a retractable safety valve mechanism 68 is provided which resides in a retracted position (see FIG. 8) during the sequential advancement of the projectile holders 52 so as not to interfere with their advancement. After a projectile holder 52 is sequentially brought into its operative launching engagement position, the safety valve mechanism 68 is moved to an extended position (see FIG. 7), such as by being pushed forward by the cylinder as described above, at which its annular periphery 70 extends into the projectile holder 52. The safety valve mechanism 68 defines an air passageway 72 through which the pressurized air from the cylinder member 18 must pass in order to launch the projectiles. The safety valve mechanism 68 also has a projectile sensing member 74 which abuts and is depressed by a suitably sized and/or shaped projectile residing in the projectile holder when the safety valve mechanism is moved to its extended position, with depression of the projectile sensing member 74 opening an occluding member 76 in the air passageway 72 to allow the pressurized air to pass through the air passageway 72 to allow the projectile in the projectile holder 52 to be launched. However, when a non-suitably sized and/or shaped projectile is in the projectile holder, such as a projectile which is shorter than a suitably sized projectile or does not have a suitable cross sectional shape, the projectile sensing member 74 is not depressed and does not open the occluding member 76, and the air passageway remains occluded to prevent pressurized air from passing through the air passageway 72 to prevent the projectile in the projectile holder from being launched despite the generation of pressurized air in the cylinder. The occluding member may have an annular sealing ring 77 which forms a sealing engagement with a land on the annular periphery 70 when the projectile sensing member is not depressed, and which is moved out of sealing engagement with the annular periphery 70 when the projectile sensing member is depressed.

Figure 7:
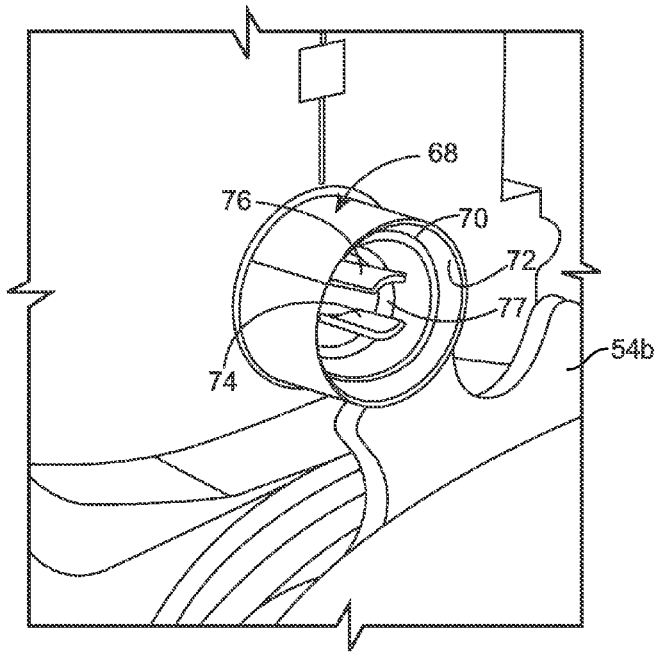
FIG. 7 is a perspective view of the safety valve mechanism, shown in its extended position.
Figure 8:
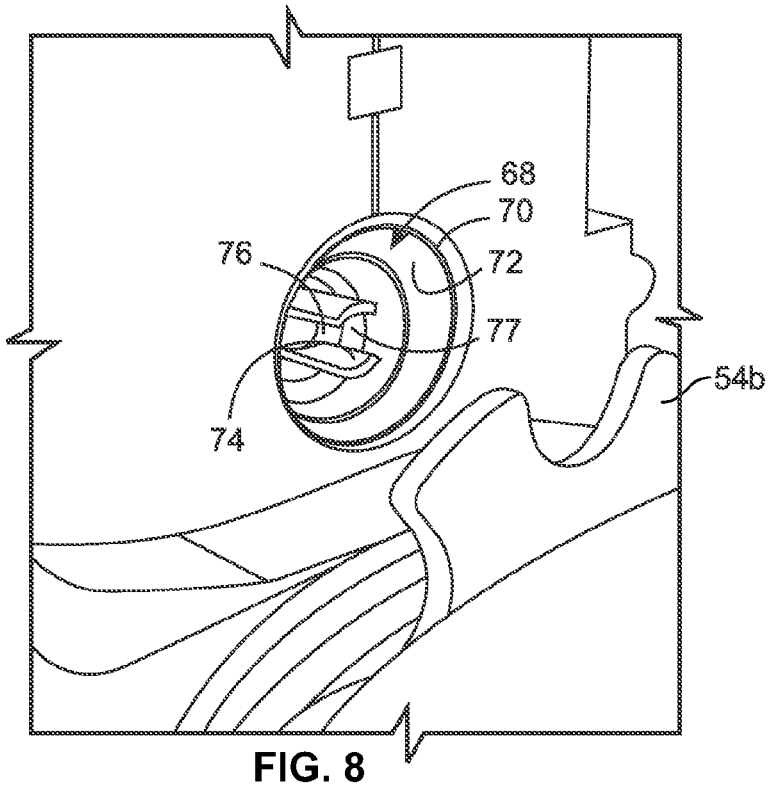
FIG. 8 is a perspective view of the safety valve mechanism, shown in its retracted position.

The safety valve mechanism 68 may be engaged with the housing and biased to its refracted position such as by a spring engaging the safety valve mechanism 68 and the housing, or the safety valve mechanism 68 may be engaged with the cylinder member to reciprocate together with the cylinder member between its forward and rearward positions, with a spring engaging the housing as well as the safety valve mechanism and/or cylinder member to bias the cylinder member to its rearward position after being released by the lever 19. FIGS. 8 and 7 show the safety valve mechanism 68 in its retracted and extended positions, respectively.

Figure 9:
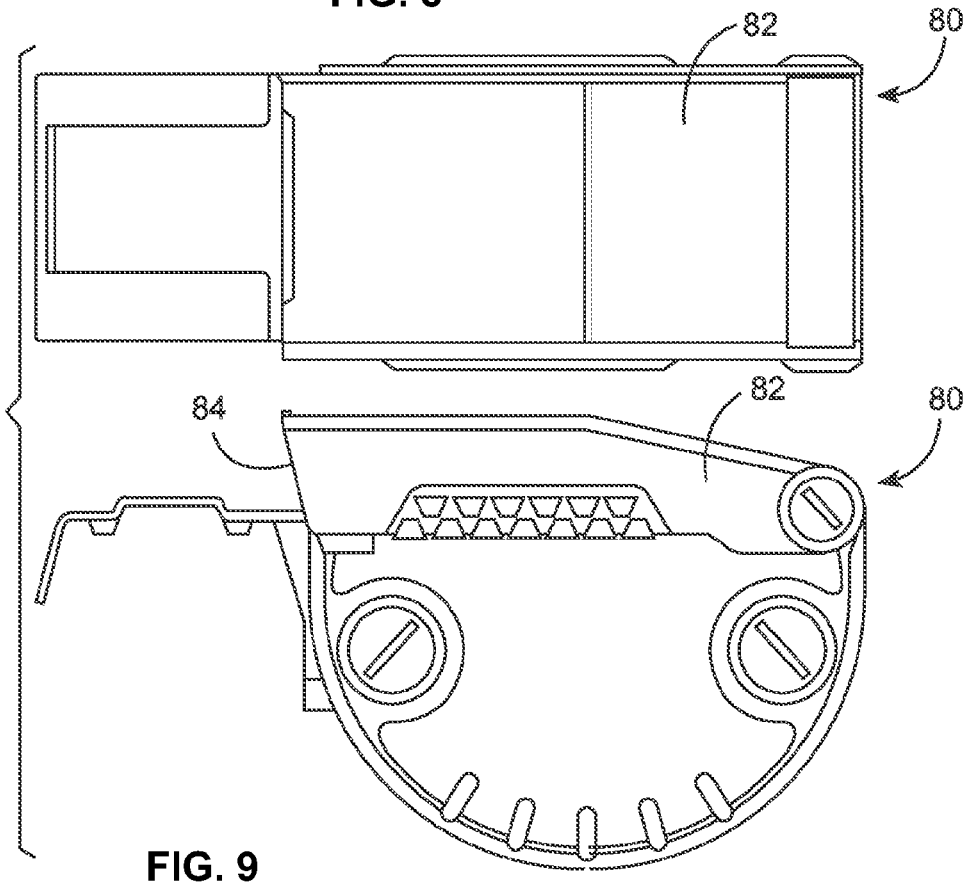
FIG. 9 is a top and side elevational view of the drum magazine of the toy projectile holder of FIG. 1.

With reference now to FIGS. 1 and 9, the toy projectile holder 10 may be provided with a detachable drum magazine 80 for holding the ammunition belt with its fully loaded projectile holders 52. After one ammunition belt full of projectiles has been launched and the drum magazine 80 depleted, the depleted drum magazine may be removed and a second drum magazine having an ammunition belt with its projectile holders 52 loaded with projectiles may be readily attached to allow further launching of additional projectiles to resumes quickly.

The drum magazine 80 may have a cover 82 which can be pivoted closed after the ammunition belt has been loaded with projectiles and loaded into the drum magazine, with the closed cover providing an opening 84 through which only one projectile holder at a time may be pulled from the drum magazine as the sprocket advancing mechanism advances the ammunition belt and pulls it from the drum magazine. A safety mechanism may be provided which operatively engages with the cover so that the motor will not operate, and hence the launcher will not operate in automatic mode, unless and until the cover is closed. Additionally, or alternatively, the toy projectile launcher may be provided with a safety mechanism which operatively engages with the drum magazine when it is mounted to the toy projectile launcher so that the motor will not operate, and hence the launcher will not operate in automatic mode, unless and until the drum magazine is properly mounted. Still further, a safety mechanism may be provided inside the drum magazine which is operatively engaged by the ammunition belt when it is properly seeded in the sprockets.

Upon release of the cylinder member 18 and its movement to its rearward position, the safety valve mechanism 68 is moved to its refracted position, at which the cylinder member and safety valve mechanism are in position to repeat the sequential launching of a plurality of further projectiles.

Figure 10:
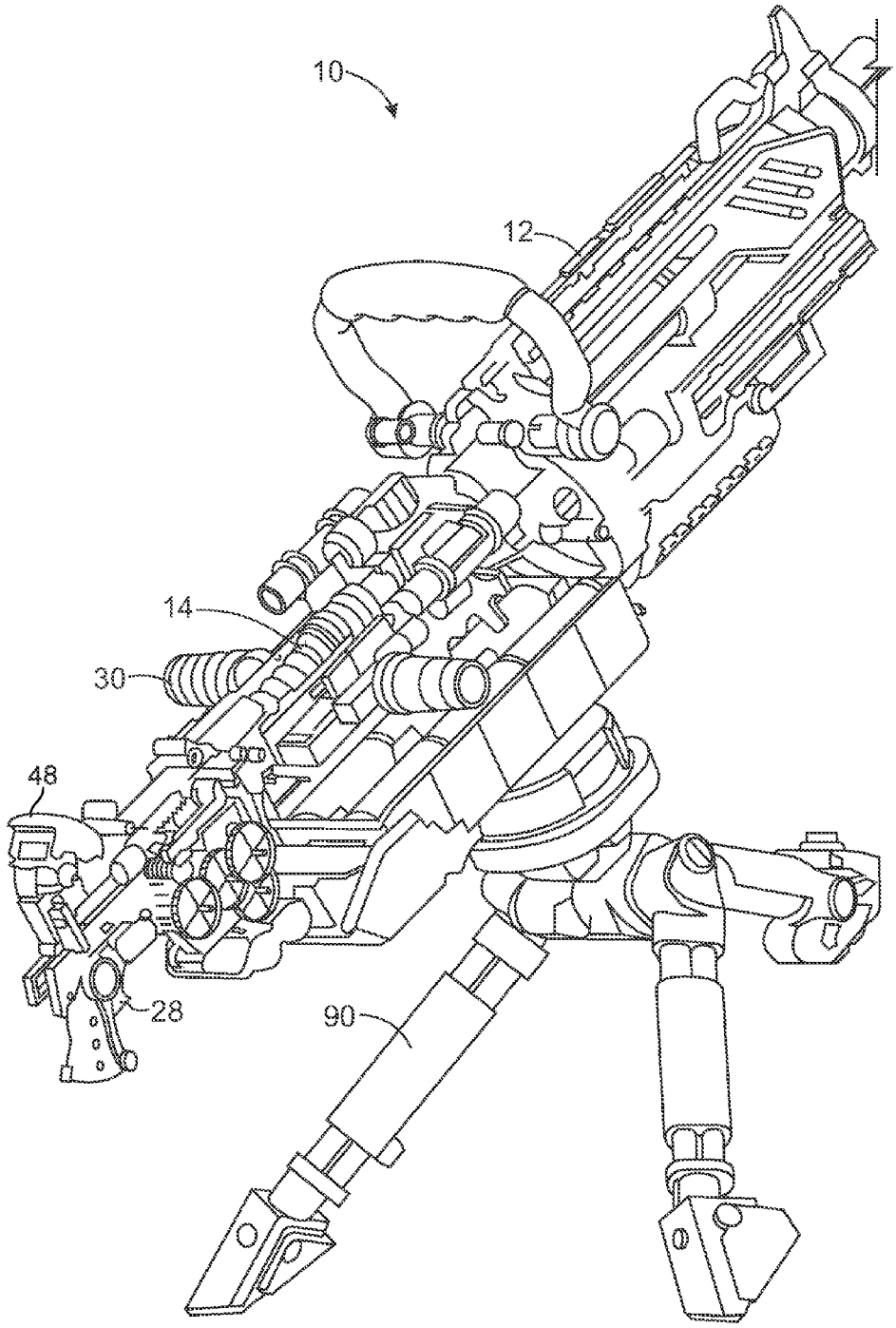
FIG. 10 is a partial perspective view of an alternative embodiment projectile launcher embodying various aspects of the present invention.

The toy projectile launcher may be rotatably mountable on a tripod 90 or other suitable mounting device which allows the launcher to be moved laterally and/or vertically while supported on a surface, so that the toy projectile holder may be operated not only when held, but also operated when supported on a surface. An alternative toy projectile launcher embodying various features of the present invention is illustrated in FIG. 10. With reference to FIG. 10, the alternative toy projectile launcher 10 includes housing 12 for aesthetic play value. The actuator mechanism 14 generates bursts of pressurized air for effecting launching of projectiles by the force of the pressurized air, is mounted to the housing 12 in a suitable manner to allow the user to manually grasp the cocking handle 30 and pull it from a forward un-cocked position to a rearward cocked position, which is operatively engaged with the trigger 28. The projectile holders are advanced into operative launching engagement with the air passageway sequentially by an advancing mechanism. The illustrated actuator mechanism 14 provides the discussed cylinder and piston assembly for the source of pressurized air establishing the rapid displacement source of pressurized air used to launch projectiles.

From the foregoing, it can be seen that there has been provided features for improved projectile launcher toys. While a particular embodiment of the present invention has been shown and described, it will be obvious to those skilled in the art that changes and modifications may be made without departing from the invention in its broader aspects. Therefore, the aim is to cover all such changes and modifications as fall within the true spirit and scope of the invention. The matter set forth in the foregoing description and accompanying drawings is offered by way of illustration only and not as a limitation. The actual scope of the invention is intended to be defined by subsequent claims when viewed in their proper perspective based on the prior art.

What is claimed is:

1. A toy projectile launcher for launching projectiles, comprising:

a housing;

a trigger mounted to the housing and movable between actuated and released positions;

a motor mounted to the housing and being actuatable upon movement of the trigger to its actuated position;

a cylinder and piston assembly having a piston and cylinder slidable relative to one another between a cocked position and an un-cocked position, with the cylinder and piston assembly generating a source of pressurized air upon movement of the piston and cylinder relative to one another from its cocked to its un-cocked position;

a biasing member for biasing the cylinder and piston assembly to its un-cocked position;

a mechanical linkage operatively interconnecting the motor with the cylinder and piston assembly to effect repeated sequential movement of the cylinder and piston assembly to its cocked position and release from its cocked position, whereby repeated intermittent sources of pressurized air are generated for sequential launching of the projectiles;

a plurality of projectile holders for receiving respective projectiles therein;

a projectile holder advancing mechanism for sequentially advancing the plurality of projectile holders into fluid communication with the pressurized air generated by the piston and cylinder assembly, the projectile holder advancing mechanism operatively engaged with the motor; and a retractable safety valve mechanism for preventing the launching of improvised projectiles, disposed between the cylinder and piston assembly and the projectile holders, with the retractable safety valve mechanism being movable between a retracted position in which it does not interfere with the projectile holders during their sequential advancement, and an extended position in which it extends into the projectile holders while they are in fluid communication with the pressurized air generated by the piston and cylinder assembly;

the safety valve mechanism being moveable to its retracted position; and the safety valve mechanism being moveable to its extended position prior to each movement of the piston and cylinder assembly from its cocked to its un-cocked position.

2. A toy projectile launcher in accordance with claim 1 in which the mechanical linkage comprises:

a sector gear operatively engaged by the motor and rotatable, the sector gear having a toothed portion and an un-toothed portion; and a rack gear slidably mounted to the housing and operatively engaged with the piston and cylinder assembly, with the rack gear sequentially engaged by the sector gear during the portions of the sector gear rotation at which the toothed portion of the sector gear is in engagement with the rack gear to move the piston and cylinder assembly to its cocked position, and the rack gear being sequentially disengaged from the sector gear during the portion of the sector gear rotation at which the toothed portion of the sector gear is not in engagement with the rack gear to allow the piston and cylinder assembly to move to its un-cocked position.

3. A toy projectile launcher in accordance with claim 1 in which the projectile holder advancing mechanism comprises a second rack gear which is sequentially engaged with a second sector gear driven by the motor.

4. A toy projectile launcher in accordance with claim 1 in which a cocking handle is operatively engaged with the piston and cylinder assembly to allow manual movement of the piston and cylinder assembly to its cocked position for operation of the launcher in a manual mode.

5. A toy projectile holder in accordance with claim 1 in which the safety valve mechanism is operatively engaged with the projectile holder advancing mechanism to move in synchronization with one another.

6. A toy projectile launcher for launching projectiles, comprising:

an air passageway through which compressed air is passable for launching the projectiles;

a plurality of projectile holders for holding respective projectiles to be launched;

a projectile advancing mechanism for sequentially advancing the projectile holders into operative launching engagement with the air passageway;

a retractable safety valve mechanism movable between a retracted position in which it does not interfere with the projectile holders during the sequential advancement of the projectile holders, and an extended position extending into the projectile holder while the projectile holder is in operative launching engagement with the air passageway; and the retractable safety valve mechanism having a dart sensing portion which is movable between an air passageway occluding position in which air is prevented from passing through the air passageway in the absence of the dart sensing portion detecting the presence of a suitable predetermined profile in the projectile holder when the safety valve mechanism is extended into the projectile holder, and an air passageway open position in which air is allowed to pass through the air passageway upon the dart sensing seal portion detecting the presence of a suitable predetermined profile in the projectile holder when the safety valve mechanism is extended into the projectile holder.

7. A toy projectile launcher in accordance with claim 6 in which:

each projectile holder has a cylindrical interior defining a central longitudinal axis and having an internal safety pin extending along the central longitudinal axis of the cylindrical interior; and each of the plurality of projectiles has a cylindrical profile corresponding to the cylindrical interior of the projectile holders, and each having a hollow central interior portion for receiving the safety protrusion member of the projectile holders to allow the projectiles to be inserted into the projectile holders, and prevent projectiles not having such a corresponding shape from being received in a projectile holder.

8. A toy projectile launcher for launching projectiles, comprising:

a housing;

a trigger mounted to the housing and movable between actuated and released positions;

a motor mounted to the housing and being actuatable upon movement of the trigger to its actuated position;

a cylinder and piston assembly having a piston and cylinder slidable relative to one another between a cocked position and an un-cocked position, with the cylinder and piston assembly generating a source of pressurized air upon movement of the piston and cylinder relative to one another from its cocked to its un-cocked position;

a biasing member for biasing the cylinder and piston assembly to its un-cocked position;

a plurality of projectile holders for receiving respective projectiles therein;

a projectile holder advancing mechanism for sequentially advancing the plurality of projectile holders into fluid communication with the pressurized air generated by the piston and cylinder assembly, the projectile holder advancing mechanism operatively engaged with the motor; and a retractable safety valve mechanism disposed between the cylinder and piston assembly and the projectile holders, with the retractable safety valve mechanism being movable between a retracted position in which it does not interfere with the projectile holders during their sequential advancement, and an extended position in which it extends into the projectile holders while they are in fluid communication with the pressurized air generated by the piston and cylinder assembly.

9. A toy projectile launcher in accordance with claim 8, comprising a mechanical linkage operatively interconnecting the motor with the cylinder and piston assembly to effect repeated sequential movement of the cylinder and piston assembly to its cocked position and release from its cocked position, whereby repeated intermittent sources of pressurized air are generated for sequential launching of the projectiles.

10. A toy projectile launcher in accordance with claim 9, wherein the retractable safety valve mechanism is moveable to its retracted position, with the retractable safety valve mechanism being moveable to its extended position prior to each movement of the piston and cylinder assembly from its cocked to its un-cocked position.

11. A toy projectile holder in accordance with claim 10 in which the retractable safety valve mechanism is operatively engaged with the projectile holder advancing mechanism to move in synchronization with one another.

12. A toy projectile launcher in accordance with claim 11, wherein the retractable safety valve mechanism prevents the launching of improvised projectiles.

13. A toy projectile launcher in accordance with claim 8 in which the mechanical linkage comprises:

a sector gear operatively engaged by the motor and rotatable, the sector gear having a toothed portion and an un-toothed portion; and a rack gear slidably mounted to the housing and operatively engaged with the piston and cylinder assembly, with the rack gear sequentially engaged by the sector gear during the portions of the sector gear rotation at which the toothed portion of the sector gear is in engagement with the rack gear to move the piston and cylinder assembly to its cocked position, and the rack gear being sequentially disengaged from the sector gear during the portion of the sector gear rotation at which the toothed portion of the sector gear is not in engagement with the rack gear to allow the piston and cylinder assembly to move to its un-cocked position.

14. A toy projectile launcher in accordance with claim 8 in which the projectile holder advancing mechanism comprises a second rack gear which is sequentially engaged with a second sector gear driven by the motor.

15. A toy projectile launcher in accordance with claim 8 in which a cocking handle is operatively engaged with the piston and cylinder assembly to allow manual movement of the piston and cylinder assembly to its cocked position for operation of the launcher in a manual mode.

* * * * *